United States Patent [19]

Lipes

[11] 4,172,349

[45] Oct. 30, 1979

[54] AUTOMATIC BAGGING MACHINE

[75] Inventor: Arnold Lipes, Montreal, Canada

[73] Assignee: Packaging Automation Machinery Co., Montreal, Canada

[21] Appl. No.: 852,678

[22] Filed: Nov. 18, 1977

[51] Int. Cl.[2] ..... B65B 43/46

[52] U.S. Cl. ..... 53/459; 53/572; 53/385

[58] Field of Search ..... 53/29, 187, 189, 384, 53/385

[56] References Cited

U.S. PATENT DOCUMENTS

| | | | |
|---|---|---|---|
| 3,605,383 | 9/1971 | Piazze | 53/189 X |
| 3,789,570 | 2/1974 | Mullins | 53/29 |
| 4,040,235 | 8/1977 | Chlipalski | 53/187 |

*Primary Examiner*—Travis S. McGehee
*Attorney, Agent, or Firm*—Alan Swabey; Robert Mitchell; Guy Houle

[57] ABSTRACT

An automatic bagging machine for holding and opening a first bag of a plurality of juxtaposed bags held in the machine in a manner whereby the first bag may be filled with a product and detached prior to release of the first bag from the plurality of bags. The bags are of the type having an extended tab secured to a portion thereof and extending above a mouth opening of the bag. The machine comprises a holding device for engaging at least a portion of the extended tab of the first bag. A retractor member is also provided for opening the mouth opening of the first bag by pulling a side wall portion of the first bag opposite to the engaged portion of the tab and away from the engaged tab. The retractor member also clamps the side wall portion to hold the bag in an open position whereby the bag is held from opposed sides for filling the bag with the product. An actuating system is also provided for releasing the holding means and clamping means, after the bag extended tab is detached, to cause the first bag with the product to be released. The invention also encompasses the method of holding, opening and detaching the first bag.

9 Claims, 4 Drawing Figures

AUTOMATIC BAGGING MACHINE

BACKGROUND OF INVENTION (a) Field of the Invention

The present invention relates to an automatic bagging machine and the method of operation therefor, and more particularly, to a machine capable of opening a first bag of a plurality of bags and filling same with a product and detaching it prior to displacing the first bag with its tab juxtaposed with the other bags.

(b) Description of Prior Art

Bagging machines for holding, transporting, filling and sealing plastic bags are well known such as disclosed in Applicant's own U.S. Pat. No. 3,946,538 issued on Mar. 30, 1976 and other prior art, for example, U.S. Pat. No. 3,731,454 issued to Ag-Pak Inc. on May 8, 1973. Such prior art is of the type where a first bag of a plurality of juxtaposed bags is engaged by clamping means and transported by the clamping means for filling and sealing the bag. Such prior art devices are fairly complex in construction due to the various clamping arms required to be activated and the displacement of the clamping mechanisms.

There exists the need for a simple, uncomplicated automatic bagging machine where a bag, having an extended tab, may be held from opposed sides while the bag is filled, and then released for transportation by other means to a bag closing station.

SUMMARY OF INVENTION

It is a feature of the present invention to provide an automatic bagging machine which will supply this need.

According to a further feature of the present invention, there is provided an automatic bagging machine which is capable of holding a first bag of a plurality of juxtaposed bags in an open position before displacing said first bag from its juxtaposed position whereby the bag is filled with a product and detached before releasing it so that the bag can be filled with light products and does not depend on its weight to detach itself from the means holding if juxtaposed.

It is a further feature of the present invention to provide an automtic bagging machine having a pneumatic system capable of holding and releasing a first bag of a plurality of juxtaposed bags to permit filling of the bag with a product, the entire operation of the bagging being effected by two cycles of operation of the pneumatic system.

A further feature of the present invention is to provide a method of holding and opening a first bag of a plurality of juxtaposed bags to permit filling the bag in its juxtaposed position with the plurality of bags whereby the first bag will detach from its juxtaposed position and release to fall by gravity.

According to the above features, from a broad aspect, the present invention provides an automatic bagging machine for holding and opening a first bag of a plurality of juxtaposed bags held in the machine in a manner whereby the first bag may be filled with a product and detached prior to release of the first bag from the plurality of bags. The bags each having an extended tab secured to a portion thereof, with the tab extending above a mouth opening of the bag. The machine comprises holding means for engaging at least a portion of the extended tab of the first bag. Bag opening means is also provided for opening the mouth opening of the first bag by pulling a side wall portion of the first bag, opposite to the engaged portion of the tab, away from the engaged tab. Clamping means is associated with the bag opening means for clamping the side wall portion to hold the bag in an open position whereby the bag is held from opposed sides for filling the bag with the product. Actuating means is provided for releasing the holding means and clamping means whereby to cause the first bag with the product in it to be displaced, due to its own weight, from the plurality of juxtaposed bags.

According to further broad aspect of the present invention, there is provided a method of holding and opening a first bag of a plurality of juxtaposed bags whereby the first bag may be filled with a product and detached prior to release of the first bag from the plurality of bags. The bags have a tab which extends above a mouth opening of the bag. The method comprises engaging a portion of the extended tab of the first bag while maintaining the first bag juxtaposed with the plurality of bags. The mouth opening is opened and a side wall portion of the first bag, opposite to the engaged portion of the tab, is pulled away from the engaged tab and clamped to hold the bag from opposed sides. The bag is then filled with a product and the engaged portion of the extended tab is released prior to releasing the bag with its product.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
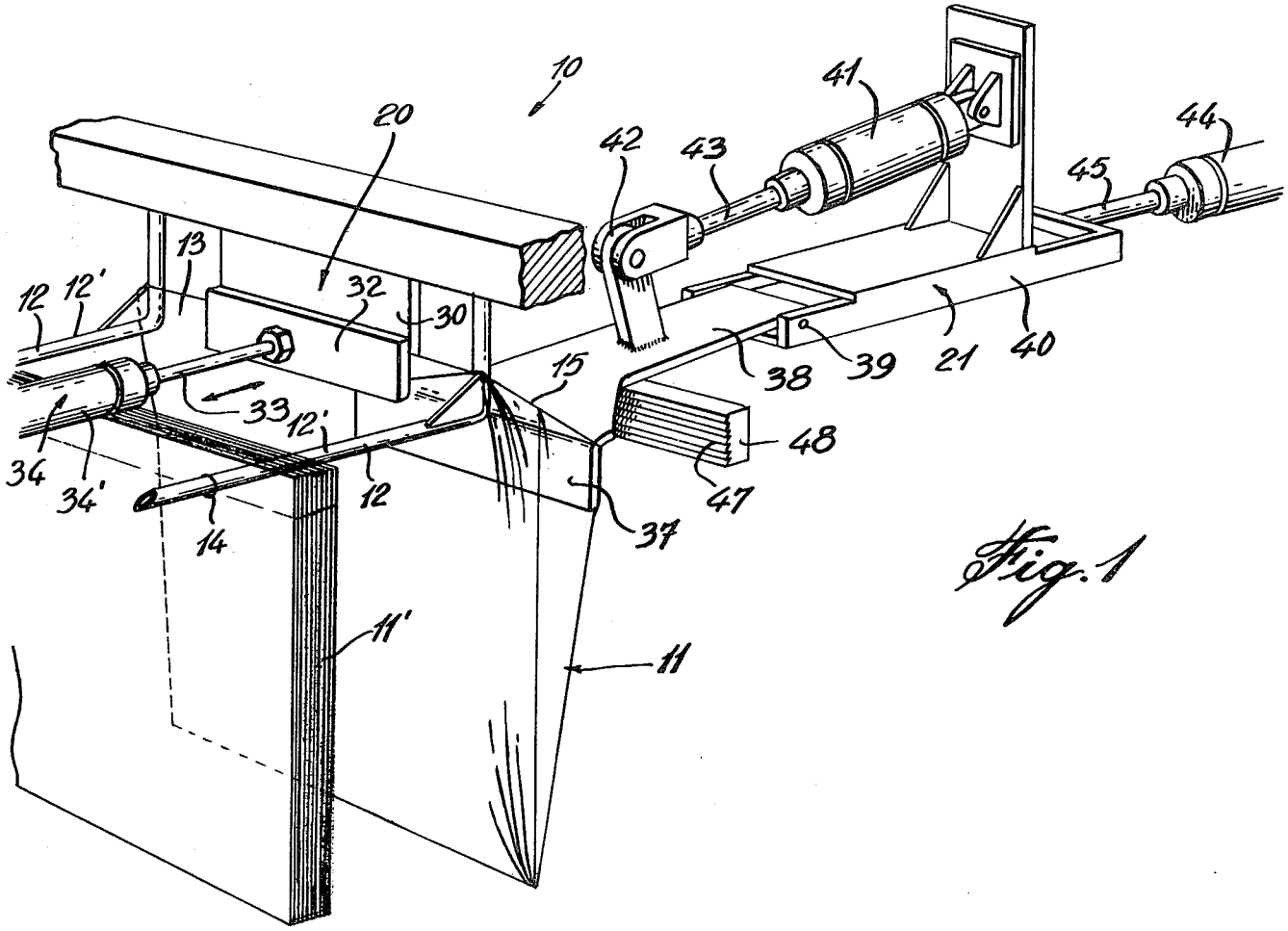
FIG. 1 is a perspective view, partly fragmented, illustrating an example of the essential parts of the bagging machine of the present invention.

Referring now to the drawings, there is shown generally at 10, the essential parts of the automatic bagging machine for holding and opening a first bag 11 of a plurality of juxtaposed bags 11' held in the machine by wicket pins 12. Each of the bags 11 has an extended tab 13 provided with two spaced apart holes 14 therein whereby the bags are slidingly retained on the wicket pins 12. Each bag is also provided with a mouth opening 15 defined between a bag rear wall 16 and a bag front wall 17, see FIG. 2.

The machine comprises generally holding means 20 for engaging at least a portion of the extended tab 13 of a first bag 11, a bag opening means 21 for opening the mouth opening 15 of the first bag by pulling a side wall portion, herein the front wall 17, of the first bag away from the engaged tab 13, and actuating means 22 for causing the holding means 20 and a clamping means 23, associated with the bag opening means 21, to release the first bag 11.

The holding means 20 is constituted by a stationary clamp 30 having a clamping surface 31 positioned in front of the extended tab 13 of the first bag 11. A displaceable clamp 32 is secured to the free end of a piston rod 33 of piston 34. The clamping surface 35 of the displaceable clamp 32 is positioned in alignment with the clamping surface 31 of the stationary clamp 30 whereby all of the extended flaps 13 are held compressed between the clamping surfaces 31 and 35 when the piston rod 33 is displaced outwardly from the piston cylinder 34'.

The bag opening means 21 comprises an air jet 36 which is positioned adjacent the mouth opening 15 of the bag whereby to direct a jet of air in the mouth opening after the extended tab 13 is engaged by the holding means 20 whereby to cause the bag to open and to permit the insert end portion 37 of a retractor member 38 to be positioned within the opening 15.

The retractor member 38 is hinged at 39 to a movable frame 40 and is displaceable arcuately in an up and down direction on the hinge connection 39 by a piston 41 mounted at a downward angle with respect to the frame 40 and having its rod end 42 secured to the retractor member 38. By extending the piston rod 43, in and out of the cylinder 41' of piston 41, the retractor member will be displaced in an arcuate up and down manner.

A further piston 44 is secured to the movable frame 40 whereby to displace the frame 40 towards and away from the first bag of the plurality of bags 11'. During a first stroke, the piston rod 43 is in a retracted position and the piston 44 is extended towards the first bag 11. During the second stroke, the piston 41 is actuated to extend the piston rod 43 and simultaneously the piston 44 retracts its piston rod 45 whereby the insert end portion 37 goes into the mouth opening and pulls the front wall 17 away from the rear wall 16 until a top portion of the front wall 17 is clamped between a clamping surface 46 of the insert end portion 37 and a clamping surface 47 of a stationary clamp 48. As the front wall 17 is pulled away from the rear wall 16, the extended tab 13 will disconnect from the wicket pins 12, as shown at 13' in FIGS. 3 and 4. To facilitate disconnection, a razor edge 12' is provided along the top of the pins 12.

Figure 3:
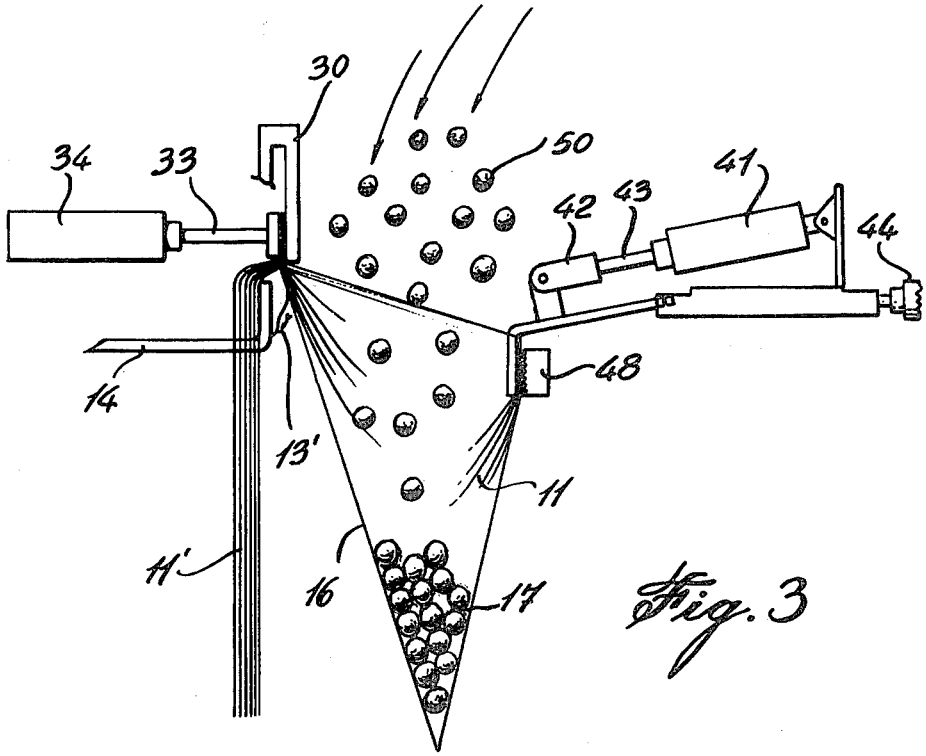
FIG. 3 is a further schematic view illustrating a further step in the operation of the bagging machine of the present invention where a product is inserted into an open bag.
Figure 4:
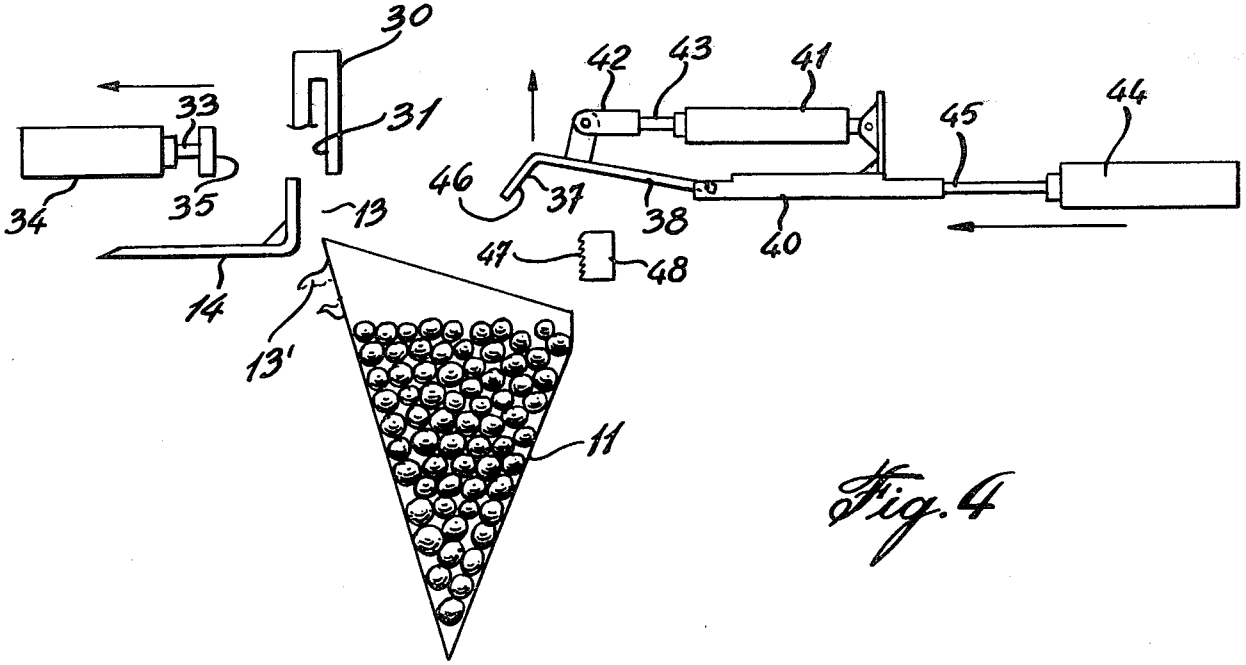
FIG. 4 is a still further schematic view illustrating a further step in the operation where the filled bag is released.

As shown in FIG. 3, when the extended tab 13 is clamped as well as a portion of the front wall 17, the bag 11 is held from opposite sides and ready to receive a product 50 therein. While the insert end portion 37 was pulling the front wall 17 of the bag 11, the extended tab 13 ripped itself free from the wicket pins 12, as illustrated in FIG. 3. After a predetermined quantity of the product 50 is inserted within the bag 11, the pistons 34, 41, and 44 are again activated to perform a release stroke, as shown in FIG. 4, with the piston 34 retracting its piston rod and, therefore, releasing the extended tab 13 and simultaneously the piston 41 retracting its piston rod thereby causing the retractor member to move upwardly with a simultaneous operation of piston 44 causing its piston rod 45 to move outwardly to cause release of the engaged top portion of the front wall 17 of the bag 11. Thus, the bag is free to fall by gravity, no matter how light its content.

Figure 2:
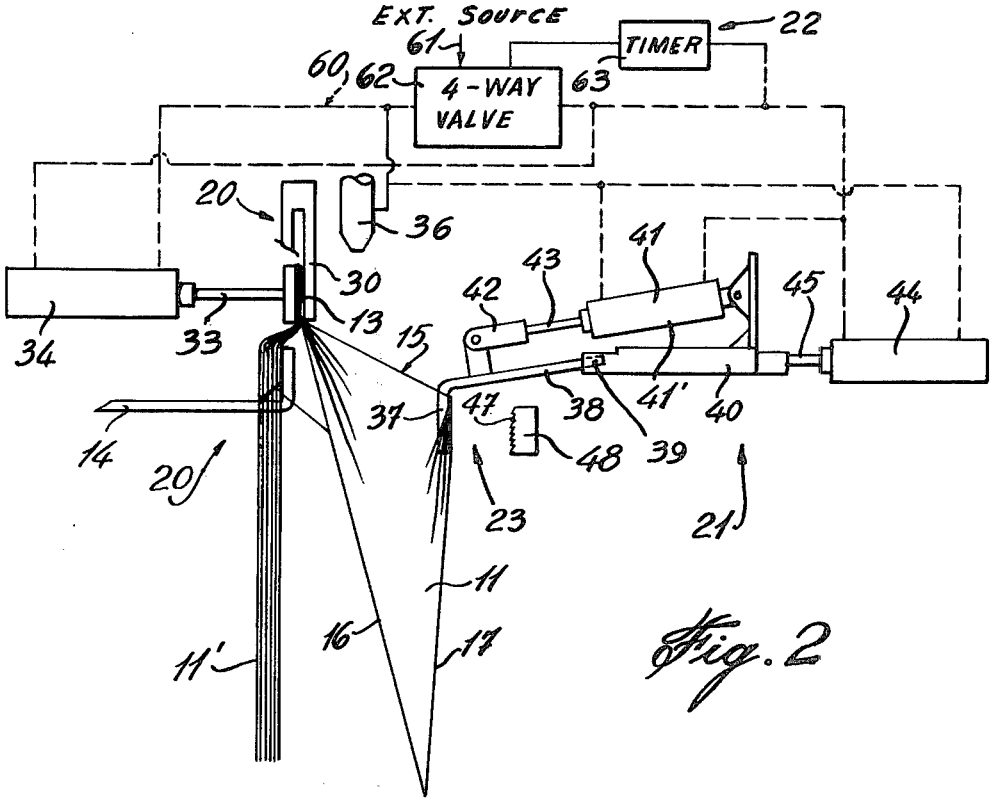
FIG. 2 is a schematic view illustrating the operation of the bagging machine of the present invention during opening of a bag.

The pneumatic system for operating the pistons is schematically illustrated at 60. The system comprises an external source of pressure (not shown) connected to an input 61 of a four-way valve 62. All of the pistons are two-stroke (double-acting) pistons and in one stroke of the operation, as illustrated in FIGS. 2 and 3, piston 34 moves against the extended tabs 13 to apply pressure to retain the first bag 11. Previously, the air jet 36 was activated whereby to cause the front wall 17 of the first bag 11 to move away from the rear wall 16. While the piston 34 clamps the tabs 13, the cylinder 41 is activated, causing the insert end portion 37 of the retractor member 38 to move within the mouth opening while piston 44 is activated to pull back the movable frame 40 to a position where the clamping surface 46 of the insert 37 clamps a top portion of the front wall 17 of the bag 11 between it and a clamping surface 47 of the stationary clamp 48. Thus, the bag is now positively held from opposed sides and ready to receive the product 50 therein. A timer 63 is connected in the circuit to provide a suitable time delay for the filling of the bag 11 prior to activating the second cycle of the pneumatic system.

FIG. 4 illustrates a second cycle of operation of the system wherein the piston 34 is activated in the opposed direction to cause retraction of its piston rod to release the extended tab 13. Simultaneously, the piston 44 is activated to move its piston rod 45 outwardly whilst the piston 41 is activated to retract its piston rod simultaneously causing the retractor member 38 to move upwardly and forwardly as indicated by the arrows. This will release all engagement with the bag 11 which will fall by gravity on conveying means (not shown) positioned below the bag 11.

It is within the ambit of the present invention to cover any obvious modifications of the example of the invention described herein, provided these fall within the definition of the broad claims appended herein. For example, the bags are not restricted to those of the type having holes in the tab to be supported on wicket pins. The holding means 20 could be constituted by having further side clamps which could engage the extended tab on opposed sides of the clamps 30 and 32 and work in reverse to the clamps 30 and 32 whereby to hold the juxtaposed bags 11' while the filled bag is being filled and released. When the clamps 30 and 32 are engaged, the side clamps would be disengaged to permit the portions of the tab extending beyond opposed side edges to the clamps 30 and 32 to bend around these and clear the side clamps. Thus, when the filled bag is released by clamps 30 and 32, the remaining juxtaposed bags are held clamped by the side clamps.

I claim:

1. An automatic bagging machine for holding and opening first bag of a plurality of juxtaposed bags held in said machine in a manner whereby said first bag may be filled with a product and detached prior to release of said first bag from said plurality of bags, said bags each having an extended tab secured to a portion thereof, said tab extending above a mouth opening of said bag, said machine comprising (i) retaining means for supporting said plurality of bags in juxtaposition, (ii) holding means for engaging at least a portion of said extended tab of said first bag, (iii) bag opening means for opening said mouth opening of said first bag by pulling a side wall portion of said first bag, opposite to said engaged portion of said tab, away from said engaged tab, while said first bag is simultaneously detached from said retaining means, (iv) clamping means associated with said bag opening means for clamping said side wall portion to hold said bag in an open position whereby said bag is held from opposed sides for filling said bag with said product, and (v) actuating means for releasing said holding means and clamping means to cause said first bag with said product to be displaced, due to its own weight, from said plurality of juxtaposed bags.

2. A bagging machine as claimed in claim 1, wherein said actuating means has two cycles of operation and is connected to said holding means and clamping means to cause said engaging, opening and grasping all in one of said two cycles, said releasing being effected in the other of said two cycles.

3. A bagging machine as claimed in claim 2, wherein said holding means is a clamping device having clamping surfaces positioned to each side of said plurality of juxtaposed bags and oppositely aligned to one another with said tabs extending therebetween.

4. A bagging machine as claimed in claim 3, wherein said bag opening means is constituted by means to cause said mouth opening to open, and a retractor member having an insert end portion displaceable to enter said mouth opening and pull said side wall portion against a stationary clamping surface which constitutes said clamping means.

5. A bagging machine as claimed in claim 3, wherein said actuating means is a pneumatic system, said holding means and clamping means being operable by pistons having two strokes, each of said two strokes being associated with said first and second cycles, respectively.

6. A bagging machine as claimed in claim 5, wherein said clamping surfaces of said clamping device are constituted by a stationary clamp and a displaceable clamp, said displaceable clamp being secured to the free end of a piston rod of one of said pistons.

7. A bagging machine as claimed in claim 6, wherein said retractor member is displaceable by a pair of said pistons, a first piston of said pair causing said insert end portion to enter and retract from said mouth opening, a second piston of said pair causing said retractor member to move towards and away from said first bag of said plurality of bags.

8. A bagging machine as claimed in claim 4, wherein said means to cause said mouth opening to open is an air jet directed at said mouth opening, said retractor member causing detachment of said first bag from said juxtaposed position by detaching said extended tab from said retaining means.

9. A method of holding and opening a first bag of a plurality of juxtaposed bags whereby said first bag may be filled with a product and detached prior to release of said first bag from said plurality of bags, each said bag having a tab extending above a mouth opening of said bag, said method comprising the steps of:

(i) retaining a plurality of said bags in juxtaposition by retaining means, (ii) engaging a portion of said extended tab of said first bag while maintaining said first bag juxtaposed with said plurality of bags;

(iii) opening and pulling a side wall portion of said first bag, opposite to said engaged portion of said tab, away from said engaged tab and clamping said side wall portion to hold said bag from opposed sides, and simultaneously detaching said first bag from said retaining means, (iv) filling said bag with a product, and (v) releasing said engaged portion of said extended tab prior to releasing said bag filled with a product.

* * * * *